US009032878B1

(12) United States Patent
Kokodis et al.

(10) Patent No.: US 9,032,878 B1
(45) Date of Patent: May 19, 2015

(54) OBSCURANT GENERATING, GROUND-BASED, NETWORKED MUNITION

(71) Applicants: Victor Kokodis, Wharton, NJ (US); George Sudol, Kenvil, NJ (US); Stephen Bielamowicz, Morristown, NJ (US); Eric Barker, Morristown, NJ (US)

(72) Inventors: Victor Kokodis, Wharton, NJ (US); George Sudol, Kenvil, NJ (US); Stephen Bielamowicz, Morristown, NJ (US); Eric Barker, Morristown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/015,212

(22) Filed: Aug. 30, 2013

(51) Int. Cl.
*F42B 23/04* (2006.01)
*F41H 9/06* (2006.01)
*F41H 3/00* (2006.01)

(52) U.S. Cl.
CPC . *F41H 3/00* (2013.01); *F42B 23/04* (2013.01); *F41H 9/06* (2013.01)

(58) Field of Classification Search
CPC ..... F42B 23/04; F41H 5/007; F41H 5/15; F41H 5/155; F41H 9/00; F41H 9/04; F41H 9/06; F41H 9/08
USPC ..... 102/334, 367, 368, 369, 404, 425, 402, 102/409
See application file for complete search history.

(56) References Cited

U.S. PATENT DOCUMENTS

| | | | | | |
|---|---|---|---|---|---|
| 4,210,555 | A * | 7/1980 | Lubbers et al. | 516/1 |
| 4,580,499 | A * | 4/1986 | Fauvel et al. | 102/401 |
| 4,580,500 | A * | 4/1986 | Fauvel et al. | 102/401 |
| 4,690,061 | A * | 9/1987 | Armer et al. | 102/401 |
| 4,938,144 | A * | 7/1990 | Demarest | 102/334 |
| 5,098,488 | A * | 3/1992 | Hassell et al. | 149/19.6 |
| 5,122,298 | A * | 6/1992 | Fry et al. | 516/2 |
| 5,133,260 | A * | 7/1992 | Grosch | 102/401 |
| 5,233,927 | A * | 8/1993 | Wulvik | 102/334 |
| 5,394,139 | A * | 2/1995 | Dards | 340/541 |
| 5,398,016 | A * | 3/1995 | Burayez | 340/426.25 |
| 5,682,010 | A * | 10/1997 | Embury, Jr. | 102/334 |
| 6,087,935 | A * | 7/2000 | Berner et al. | 340/541 |
| 6,094,135 | A * | 7/2000 | Sugimoto et al. | 340/541 |
| 6,470,784 | B1 * | 10/2002 | Bonavita et al. | 89/36.17 |
| 6,484,640 | B1 * | 11/2002 | Schneider et al. | 102/334 |
| 6,655,292 | B1 * | 12/2003 | Salzeder | 102/334 |
| 6,799,517 | B1 * | 10/2004 | Cahill | 102/401 |
| 7,337,724 | B2 * | 3/2008 | Sibum et al. | 102/334 |
| 7,975,615 | B1 * | 7/2011 | Apple | 102/512 |
| 8,117,966 | B1 * | 2/2012 | Graber | 102/498 |
| 8,245,644 | B1 * | 8/2012 | Haas | 102/334 |
| 8,776,692 | B1 * | 7/2014 | Fiala et al. | 102/334 |
| 2004/0232334 | A1 * | 11/2004 | Gainsborough | 250/330 |
| 2006/0169163 | A1 * | 8/2006 | Sibum et al. | 102/334 |
| 2007/0022896 | A1 * | 2/2007 | Bornstein et al. | 102/401 |
| 2007/0119328 | A1 * | 5/2007 | Maglio et al. | 102/334 |
| 2009/0122144 | A1 * | 5/2009 | Latham et al. | 348/155 |
| 2010/0128123 | A1 * | 5/2010 | DiPoala | 348/143 |
| 2012/0092163 | A1 * | 4/2012 | Hart | 340/541 |
| 2014/0020588 | A1 * | 1/2014 | Erbach et al. | 102/334 |
| 2014/0306818 | A1 * | 10/2014 | Batchelder et al. | 340/501 |

* cited by examiner

*Primary Examiner* — Bret Hayes
*Assistant Examiner* — Derrick Morgan
(74) *Attorney, Agent, or Firm* — Henry S. Goldfine

(57) ABSTRACT

An Ottawa Convention—compliant system that replaces the current battlefield utility provided by anti-personnel landmines. This system utilizes obscurants to inhibit and deter the enemy's ability to breach and clear ground based mine and munition systems.

11 Claims, 8 Drawing Sheets

OBSCURANT GENERATING, GROUND-BASED, NETWORKED MUNITION

GOVERNMENTAL INTEREST

The invention described herein may be manufactured and used by, or for the Government of the United States for governmental purposes without the payment of any royalties thereon.

FIELD OF THE INVENTION

The present invention generally relates to the field of munitions such as landmines. Particularly, the present invention relates to an Ottawa Convention—compliant system that replaces the current battlefield utility provided by anti-personnel landmines. The present system utilizes obscurants to inhibit and deter the enemy's ability to breach and clear ground-based mine and munition systems.

BACKGROUND OF THE INVENTION

Current United States Army tactics are to utilize anti-vehicular landmines during military operations to limit the enemy's ability to maneuver on the battlefield. Anti-personnel landmines emplaced among the anti-vehicular landmines are used solely to inhibit the enemy in their ability to clear the anti-vehicular landmines.

In an effort to end the risk to noncombatants from unexploded landmines, the United States developed anti-personnel landmines (APLs) and anti-vehicle landmines (AVLs) that self-destruct and self-deactivate with a high degree of reliability.

The current United States landmine policy stems from its obligations under the Convention on Certain Conventional Weapons (COW) and Amended Protocol II of the CCW and a desire to mitigate civilian casualties caused by landmines. This policy seeks to strike a balance between maintaining the ability to use landmines in future military conflicts and addressing the humanitarian concerns raised by persistent landmines.

The United States has been assessing the effects of the Ottawa Convention on its landmine policy. The Ottawa Convention bans the manufacture and use of all anti-personnel landmines, which it defines as "a mine designed to be exploded by the presence, proximity or contact of a person and that will incapacitate, injure or kill one or more persons." The convention, however, does not apply to anti-vehicle landmines.

Membership in the Ottawa Convention would obligate the United States to cease the manufacture and use of all anti-personnel landmines regardless of circumstances. The entire United States stockpile of anti-personnel landmines would be banned, regardless of whether they are detectable, self-destructing, self-deactivating, or deployable pursuant to the requirements of Amended Protocol II.

As a result, the United States would rely purely on anti-vehicle landmines for military fields operations. However, anti-vehicle landmines can be cleared by personnel or deminers who will no longer be deterred by the presence of anti-personnel landmines.

There is therefore a need for a system for use as an integral part of anti-vehicle landmines/munitions or as a standalone device that deters enemy de-mining efforts. This system should pose no risk to non-combatants yet still prevent deminers from having free movement within the anti-vehicle landmine/munition field. This in turn would mitigate the ability to de-mine the anti-vehicle munitions within the field. The need for such a system has heretofore remained unsatisfied.

SUMMARY OF THE INVENTION

The present invention complies with the intent of the Ottawa convention by addressing the humanitarian concerns related to anti-personnel landmines while still providing an effective means of deterring enemy de-miners from clearing anti-vehicle mine/munition fields through the use of obscurants. This system prevents de-miners from having free movement within the landmine/munition field, which in turn would mitigate the ability to de-mine the anti-vehicle mines/munitions within the field.

To this end, the present system incorporates an obscurant generating device (or obscurant generator), and can be integral to an anti-vehicle landmine/munition or used as a standalone device. The system uses personnel sensors to detect movement within a mine/munition field. Based on the sensed movement, the system selectively initiates the optimal number of obscurant generators. This will prevent the intruders from having free movement within the field, which in turn will mitigate their ability to defeat the anti-vehicle mines/munitions within the field.

The system can be networked with a plurality of other munitions/sensor systems to activate the obscurant generators that provide optimal concealment. The system is also capable of preventing multiple, concurrent intrusions and can be used in a fully autonomous mode.

As a result, the present system will be compliant with the Ottawa Convention. It maintains overall effectiveness of ground based anti-vehicle mine/munition systems.

The present invention provides mine/munition field protection by deterring or delaying the clearing of the anti-vehicle mine/munition systems. This system can be fully autonomous and does not require any additional modifications to existing Tactics, Techniques, and Procedures (TTP's) to meet the requirements of the Ottawa treaty nor does it add additional Military Occupational Specialties (MOS's) or manpower to employ.

Furthermore, this system can be used to inhibit the enemy's ability to clear or counter other ground based systems including, but not limited to, networked munitions systems and sensors.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
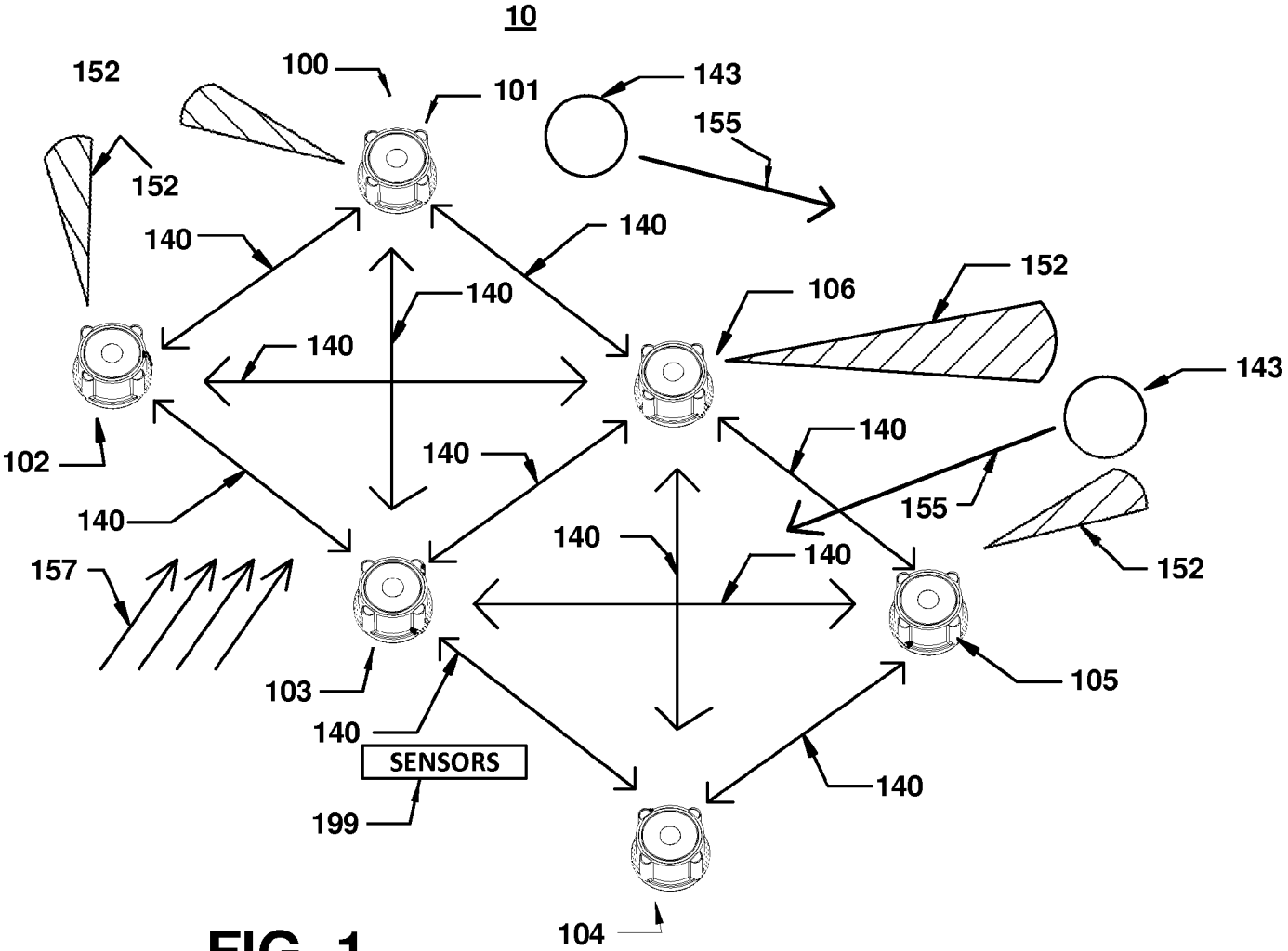
FIG. 1 is a schematic view of an exemplary mine field in which an exemplary system or network of obscurant generating munitions are emplaced according to the present invention.
Figure 2:
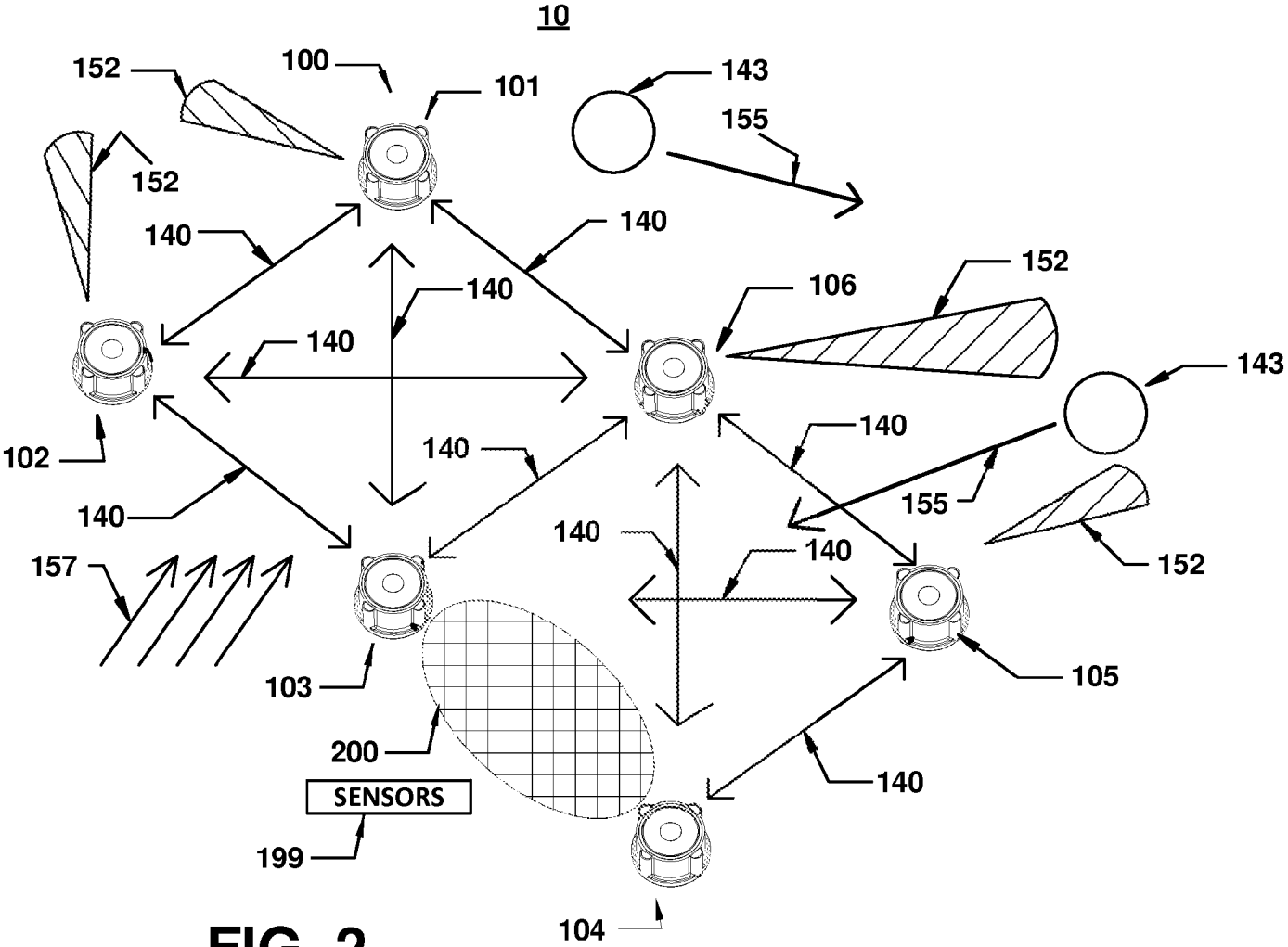
FIG. 2 is another schematic view of the mine field of FIG. 1, showing the networked munitions generating an obscuring field to shield the munitions from the view of intruders.

FIGS. 1 and 2 illustrate a mine field 10 in which an exemplary network (or system) 100 of obscurant generating munitions or devices 101, 102, 103, 104, 105, 106 are emplaced according to the present invention. While the network 100 is shown as including six munitions 101-106, it should be clear that the concept of the present invention is equally applicable to a different number of munitions (or to a single munition).

In the present illustration, the munitions 101-106 represent anti-vehicle mines or devices that are physically distributed across the mine field 10. The munitions 101-106 are also wirelessly networked to exchange sensed, collected, and calculated data, in order to ensure an optimal cloaking obscurant coverage. Alternatively, some or all the munitions 101-106 can be connected via cables or wires, for a selective distribution of data and power.

The arrows that are labeled 140 indicate various, exemplary, non-exclusive, data and/or power interconnections between the munitions 101-106. In addition, while the munitions 101-106 are shown as being interconnected to form an internal network with a distributed processing power, it should be clear that the munitions 101-106 can also be connected to an external network for added control.

In operation, some or all the munitions 101-106 continuously scan the mine field 10 for movement of intruders 143. The various scanning fields of the munitions 101-106 are indicated by the numeral reference 152. Scanning is performed by some combination of widely available personnel detection sensors 199, including but not limited to electro-optical/infrared (EO/IR) sensors, radars, passive infrared (FIR) sensors, and seismic sensors. Complementary sensing modes and tailored algorithms perform target discrimination to prevent false detections on non-humans.

While the sensors 199 are exemplified by a single box that is placed within the mine field 10, it should be understood that some or all the sensors 199 may be distributed and networked throughout the mine field 10. Alternatively, some or all the sensors 199 may be incorporated within the munitions 101-106.

Once the intruder for intruders) 143 is identified, then the munitions 101-106 start an internal communication to share data that are sensed by the various munitions 101-106. As an example, the sensed data can be the intruder's position, proximity, and direction of movement 155, the wind direction 157, and any other relevant data, such as human or non-human intruder, speed of intruder, number of intruders, etc. that are sensed by the munitions 101-106.

Based on the sensed data, the munitions 101-106 individually or collectively calculate the optimal cloaking obscurant coverage and trigger the appropriate munitions, such as 103, 104 to dispense an obscurant field 200, as shown in FIG. 2, in order to conceal the munitions that are expected to be detected and demined by the intruder 143.

While the munitions 101-106 can be identical in function and design, it should be clear that only some of the munitions may include the obscurant generation feature, while other munitions can assume specialized functions, such as telecommunications, processing, obscurant generation, etc.

Figure 3:
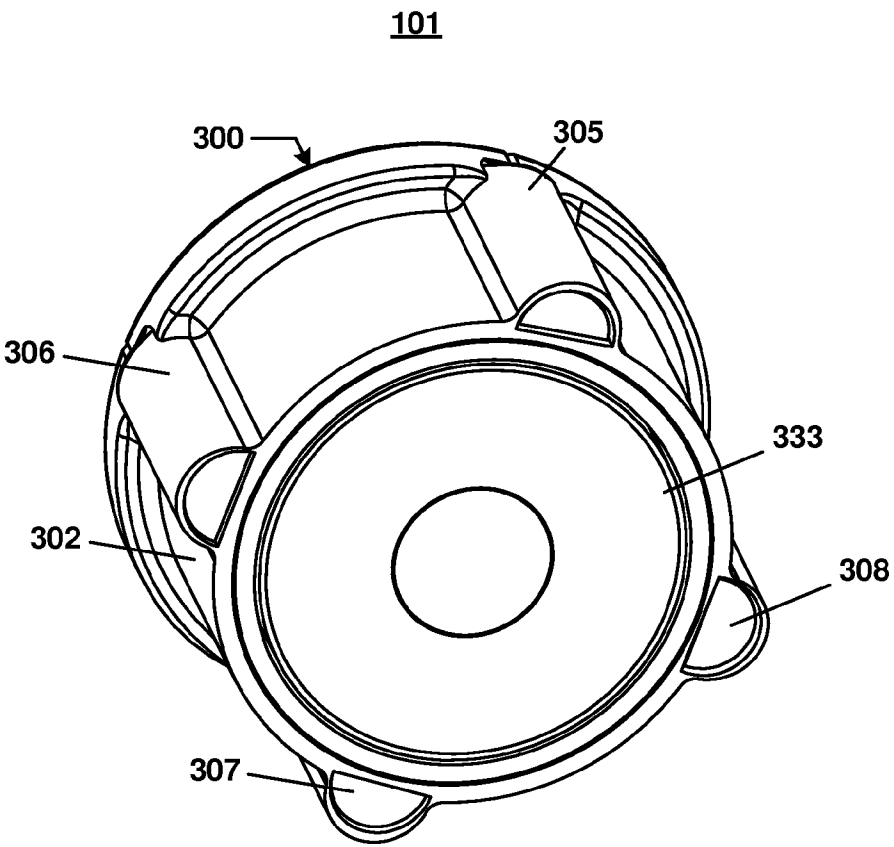
FIG. 3 is an enlarged, isometric view of an obscurant generating munition according to one embodiment of the present invention.
Figure 4:
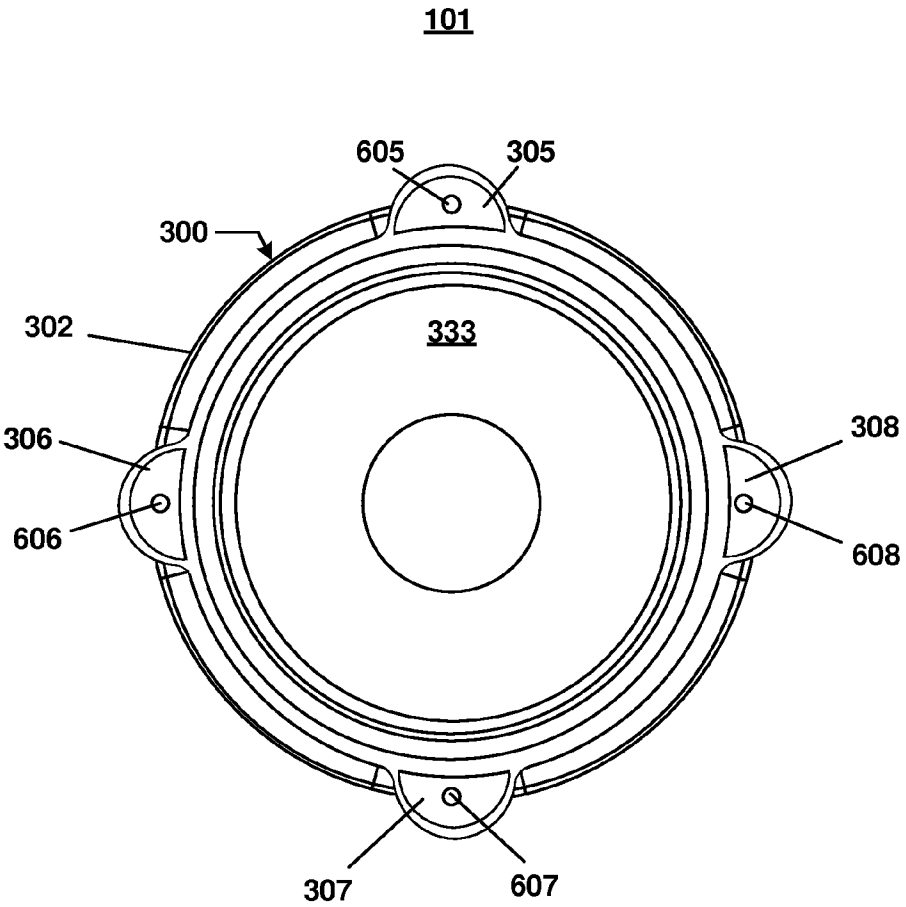
FIG. 4 is an enlarged bottom view of the obscurant generating munition of FIG. 3.
Figure 5:
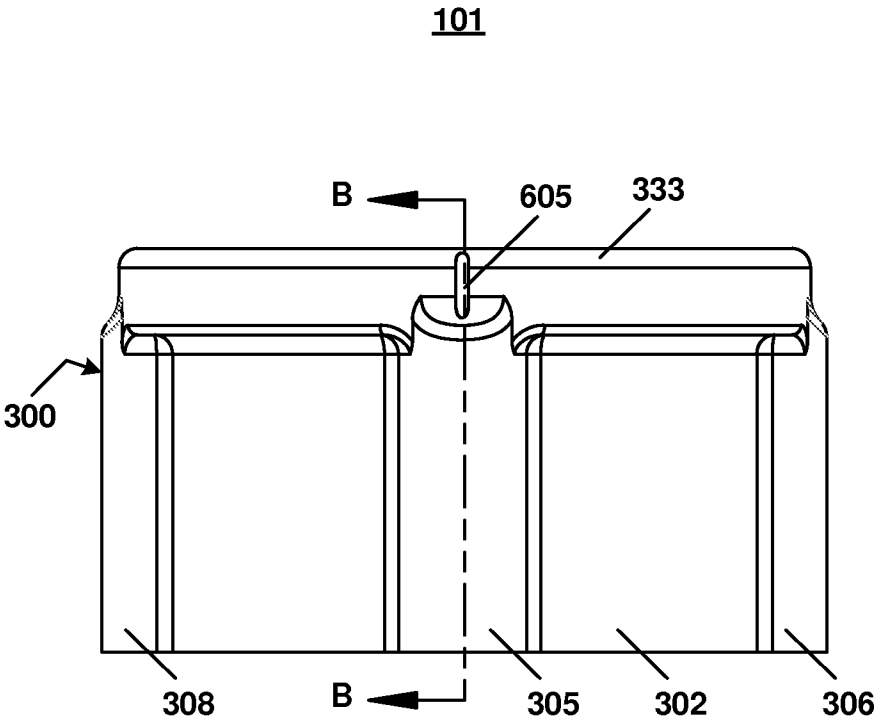
FIG. 5 is a side view of the obscurant generating munition of FIGS. 3 and 4.

FIGS. 3, 4, and 5 illustrate an exemplary obscurant generating munition, i.e., 101, according to one embodiment of the present invention. The munition 101 generally includes a housing 300 that contains and protects the inner components, as it will be explained later. The housing 300 and the inner components have to withstand forces that are expected be exerted on the munition 101. The housing needs to be sufficiently strong, and could be made of plastic, metal, a composite material, or any other suitable material.

The shape of the housing 300 is not crucial to the implementation of the present invention. In this particular embodiment, the housing 300 has a generally circular cross-section.

The munition 101 further includes a munition housing 333 that protects the internal components of the munition 101.

The housing 300 further includes a plurality of obscurant compartments 305, 306, 307, 308 that protrude from a peripheral body 302 of the housing 300. Preferably but not necessarily, the obscurant compartments 305-308 are symmetrically, peripherally disposed relative to the peripheral body 302. In addition, while only four obscurant compartments 305-308 are illustrated, it should be clear that a different number of compartments may be used.

As an example, a single compartment may be formed. Furthermore, while in the preferred embodiment, the obscurant compartments 305-308 are filled with the same obscurant material (or obscurant generator), it should be clear that each of some of the obscurant compartments 305-308 may dispense an obscurant of a different composition.

When the munition 101 is triggered, it dispenses the obscurant contained in the obscurant compartments 305-308 in the form of a cloud 200 that minimizes the intruder's 143 visibility.

As an example, each obscurant compartment 305-308 includes a volume that is filled with Terephthalic Acid (TA, having a chemical formula C8H6O4). If should be understood that obscurant compositions are available, known, or will become available.

Once a valid target signature is obtained based on the collected data, an obscurant controller electronics and processor 630 (FIG. 6) issues a fire command. The fire command functions an electric match (i.e., 732, FIG. 7) which in turn, ignites a starter slug (i.e., 733, FIG. 7). The burning started slug catches fire, causing the TA smoke mixture to produce a thick white smoke. The duration of smoke screen or cloud 200 may range between approximately 25 to 70 seconds, average burn-time.

In addition, based on the collected data, the triggering of the munition 101 does not necessarily cause the entire load of obscurant within the obscurant compartments 305-308 to be dispensed. Rather, it would be preferable to dispense only the required amount of obscurant that is necessary to provide the desired cloaking result.

The obscurant release ports 605, 606, 607, 608 (FIG. 6) from which the obscurant is dispensed, are opened since the obscurant is of a solid composition and does not require protection from the elements. The obscurant release ports 605, 606, 607, 608 can be designed so that they are out of direct line with the actual obscurant material.

Furthermore, the triggering of the munition 101 may cause the obscurant compartments 305-308 to be activated sequentially rather than concurrently, after a predetermined (or desired) time delay, such as one second or a fraction thereof, to achieve the desired cloaking cloud density.

Figure 6:
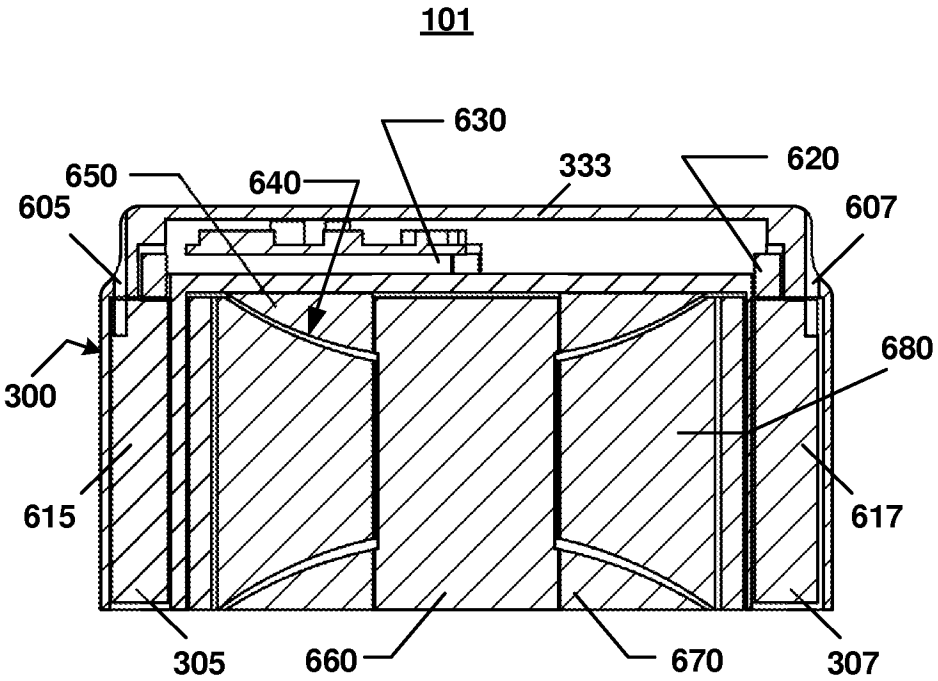
FIG. 6 is a sectional view of the obscurant generating munition of FIG. 5, taken along line B-B.

FIG. 6 is a sectional view of the obscurant generating munition 101 of FIG. 5, taken along line B-B thereof, illustrating an exemplary disposition of the internal components of the munition 101. Each obscurant compartment, i.e., 305, 307, contains an obscurant generator 615, 617.

As further illustrated in FIG. 4, each obscurant compartment 305, 306, 307, 308 includes a valved obscurant release port 605, 606, 607, 608 that selectively allows the release of the obscurant, as instructed by the obscurant controller electronics and processor 630.

In this embodiment, the obscurant controller electronics and processor 630 is illustrated as being housed within the housing 300 of the munition 101. It should be clear that the obscurant controller electronics and processor 630 can be a separate, standalone device that collects the data from the various munitions 101-106, in the field 10.

The obscurant controller electronics and processor 630 can be located within the field 10, at a close distance from the field 10, or remotely from the field 10. The obscurant controller electronics and processor 630 can include a telecommunications module (e.g., a transceiver) and a processor (or CPU).

The function of the obscurant controller electronics and processor 630 is to collect the data that are collected or sensed by the various munitions 101-106 and to calculate the most optimal cloaking path, which will prevent the intruders 143 from having free movement within the field 10, and will thus mitigate their ability to defeat the anti-tank/anti-vehicle munitions within the field 10. The munition 101 can be designed to prevent multiple intrusions and can be used in a fully autonomous mode.

Upon determination of the optimal cloaking path, the obscurant controller electronics and processor 630 activates an obscurant initiator 620, in order to selectively open the obscurant release ports 605-608, for releasing the obscurant. As shown in the exemplary embodiment of FIG. 7, the obscurant initiator 720 houses an electronic match 732 and starter slug 733).

A communications module 650 is emplaced within the housing 300, to enable the munition 101 to communicate with the other munitions 102-106 in the field, or with a remote location.

The remaining components of the munition, include a warhead 640, a warhead energetic charge 680, warhead electronics, and a power module 660, all of which are either known or available in the art, and thus will not be described herein in detail. The power module 660 provides the necessary power to the munition warhead and related energetic function, and further to the other internal electronic components described herein, that relate to the dispensation of the obscurant.

Figure 7:
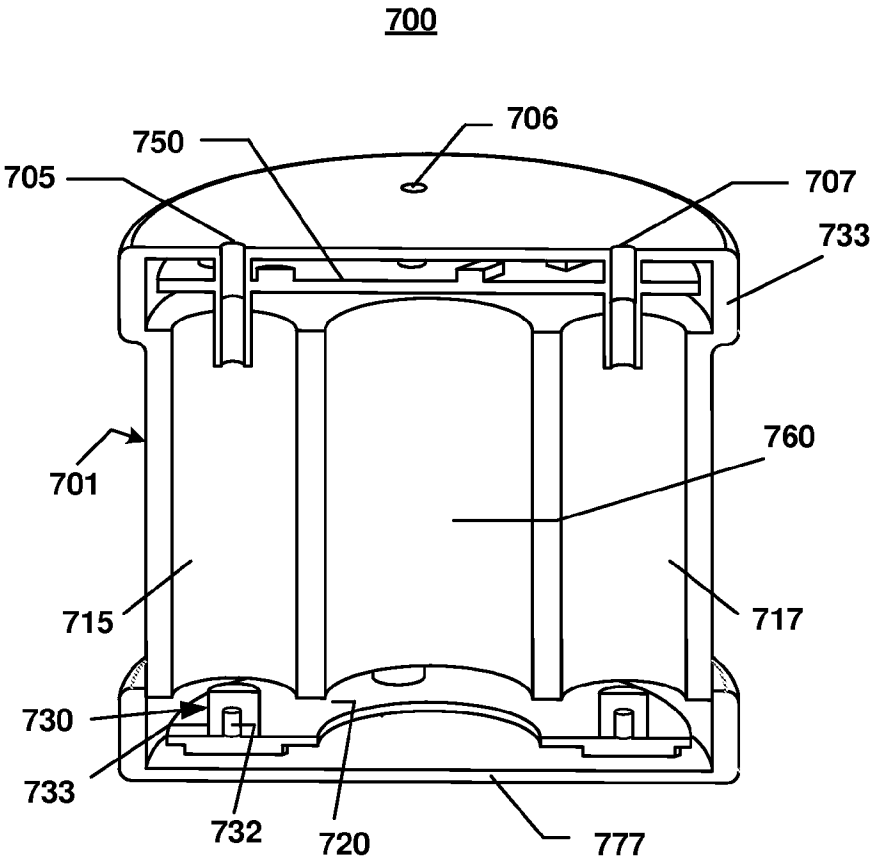
FIG. 7 is a sectional view of a standalone obscurant generating device according to the present invention, with the cross-hatching removed for clarity of illustration.

FIG. 7 illustrates a standalone obscurant generating device 700 according to the present invention. The obscurant generating function of the device 700 is generally similar to that of the munition 101. FIG. 7 also illustrates the design flexibility of the present invention in allocating the physical placement of the internal components within the obscurant generating device 700.

The obscurant generating device 700 includes a housing 701 that is generally similar in structure and composition to the housing 300. A flat or dome shaped munition housing 733 that accommodate the various valved obscurant release ports, i.e., 705, 706, 707 of the obscurant generators 715, 717 (only two obscurant generators are illustrated in FIG. 7).

A power module 760, that is similar in design and function to the power module 660 is placed centrally (or axially) to power the obscurant generators 715, 717, the obscurant controller electronics and processor 720, and an obscurant initiator 730.

In this embodiment, the obscurant initiator 730 is placed near a bottom plate 777, along side the obscurant controller electronics and processor 720. The obscurant initiator 730 houses an electronic match 732 and a starter slug 733.

Figure 8:
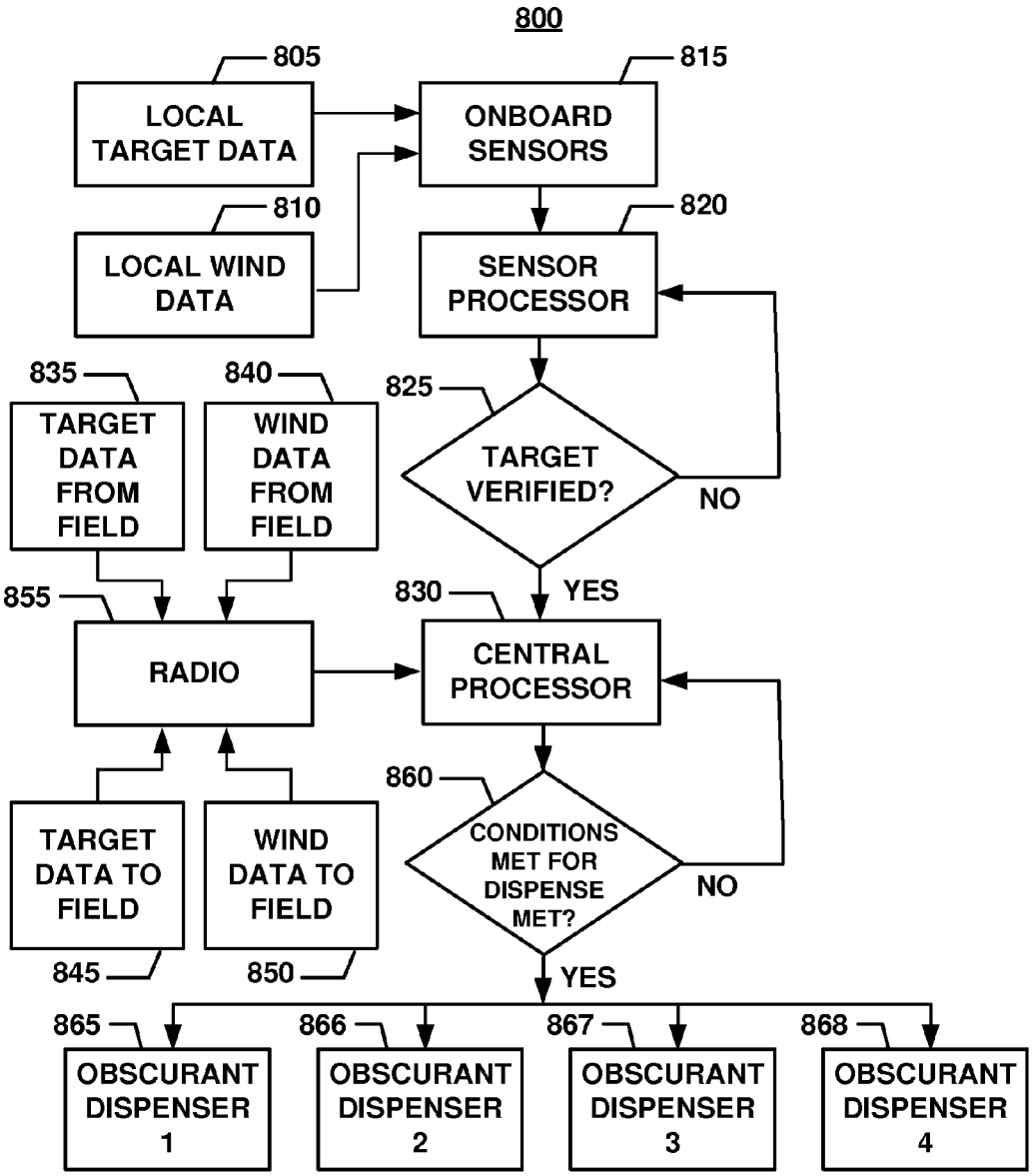
FIG. 8 represents a device logic diagram of an exemplary obscurant generator munition of the present invention.

FIG. 8 represents a device logic diagram 800 of an exemplary obscurant generator munition 101 according to the present invention. According to this specific, exemplary embodiment, input sensor data, such as local target data 805 and local wind data 810 are sensed by onboard sensors 815 and/or by sensors 199.

The sensed data 805, 810 are fed to an onboard processor 820 that forms part of the obscurant controller electronics and processor 630. In turn, the onboard processor 820 determines at decision step 825, if a target, such as an intruder 143 has been detected or verified by the sensor processor 820. If it has not, then the sensor processor keeps analyzing the input sensor data 805, 810.

If, however, the sensor processor 820 determines at decision step 825 that the target has been verified, a central processor 830 that forms part of the obscurant controller electronics and processor 630, analyses additional data, such as target data from the field 835, wind data from the field 840, target data to the field 845, and wind data to the field 850. The additional data may be transmitted to the central processor 830, via a wireless or radio network 855.

The central processor 830 determines at step 860 if the dispensation conditions for dispensing the obscurant (i.e., 615, 617) are met. If it is determined that these conditions have not been met, then the central processor 860 keeps analyzing the acquired data and monitoring dispensation conditions.

Once the central processor 830 determines, at decision step 860, that the dispensation conditions are met, then it determines the dispensation pattern, including the selection of the obscurant compartments 305-308 from which the obscurant will be dispensed, as well as the obscurant dispensation rate.

In this particular example, four obscurant dispensers 865, 866, 867, 868 are respectively associated with the obscurant compartments 305, 306, 307, 308. The dispensation pattern of the obscurant is optimized so that the obscurant cloud 200 is maximized.

It should be understood that other modifications might be made to the present obscurant generating, ground-based, networked munition design without departing from the spirit and scope of the invention.

What is claimed is:

1. A munition system that inhibits the ability to breach a ground-based mine field by providing a concealment to the munitions within the ground-based mine field, the munition system comprising:

(a) a plurality of sensors that are networked to collect field data indicative of an intrusive movement within the ground-based mine field;

(b) at least some of which sensors are incorporated within the munitions;

(c) said field data including:

any movement within the minefield;

whether the movement is caused by an intruder;

whether the intruder is human or non-human;

the number of intruders;

the direction of movement of each intruder;

the speed of movement of each intruder; and data on the wind;

(d) a processor that analyses the collected field data;

(e) at least one obscurant compartment that contains an obscurant generator; and (f) based upon the analyzed field data, the processor causing the obscurant generator to produce an obscurant smoke screen, and further causing the obscurant smoke screen to be selectively released from the at least one obscurant compartment in order to optimally conceal the munitions.

2. The munition system of claim 1, wherein the at least one obscurant compartment includes a valved obscurant release port that selectively allows the release of the obscurant.

3. The munition system of claim 1, wherein the munition system is integrated with at least one anti-vehicle munition.

4. The munition system of claim 1, wherein the munition system is a standalone device for use in a fully autonomous mode.

5. The munition system of claim 1, wherein the at least one obscurant compartment includes a plurality of separate obscurant compartments.

6. The munition system of claim 5, wherein each of the plurality of separate obscurant compartments contain obscurant generators that produce different obscurants.

7. The munition system of claim 5, wherein at least two of the plurality of separate obscurant compartments contain obscurant generators that produce different obscurants.

8. The munition of claim 5, wherein the processor selectively initiates an optimal number of the plurality of obscurant generators.

9. The munition of claim 1, wherein the munitions include anti-vehicle munitions.

10. The munition system of claim 1, wherein the plurality of sensors include any one or more of: an electro-optical/infrared (EO/IR) sensor, a radar, a passive infrared (PIR) sensor, and a seismic sensor.

11. The munition system of claim 1, wherein the obscurant includes Terephthalic Acid, C8H6O4.

* * * * *